US006392563B1

(12) United States Patent
Paquette et al.

(10) Patent No.: US 6,392,563 B1
(45) Date of Patent: May 21, 2002

(54) TRAFFIC LIGHT BACKUP SYSTEM USING LIGHT-EMITTING DIODES

(75) Inventors: Daniel Paquette, Montreal; Nicholas Krouglicof, Montreal-Ouest, both of (CA)

(73) Assignee: 9022-6523 Quebec Inc., Montreal (CA)

( * ) Notice: Subject to any disclaimer, the term of this patent is extended or adjusted under 35 U.S.C. 154(b) by 0 days.

(21) Appl. No.: 09/461,334

(22) Filed: Dec. 15, 1999

Related U.S. Application Data

(60) Provisional application No. 60/112,337, filed on Dec. 16, 1998.

(51) Int. Cl.[7] ..... G08G 1/095

(52) U.S. Cl. ..... 340/907; 340/693.2; 340/901; 340/912; 340/916; 340/930

(58) Field of Search ..... 340/907, 916, 340/931, 901, 905, 912, 909, 930, 906, 693.2; 362/800

(56) References Cited

U.S. PATENT DOCUMENTS

| | | | | |
|---|---|---|---|---|
| 3,641,487 A | | 2/1972 | Rogers et al. | 363/89 |
| 3,895,345 A | | 7/1975 | Elvers et al. | 340/41 R |
| 5,010,336 A | * | 4/1991 | Mosele et al. | 340/907 |
| 5,208,584 A | | 5/1993 | Kaye et al. | 340/907 |
| 5,327,123 A | | 7/1994 | Heimann et al. | 340/916 |
| 5,633,629 A | * | 5/1997 | Hochstein | 340/907 |
| 5,661,645 A | | 8/1997 | Hochstein | 340/931 |
| 5,663,719 A | * | 9/1997 | Deese et al. | 340/912 |
| 5,898,389 A | * | 4/1999 | Deese et al. | 340/907 |

FOREIGN PATENT DOCUMENTS

| | | |
|---|---|---|
| EP | 42 03 152 | 5/1992 |
| EP | 0 726 554 | 8/1996 |

* cited by examiner

*Primary Examiner*—Edward Lefkowitz
*Assistant Examiner*—Davetta W. Goins
(74) *Attorney, Agent, or Firm*—Oblon, Spivak, McClelland, Maier & Neustadt, P.C.

(57) ABSTRACT

A traffic light backup system for use with a traffic light is described. The traffic light backup system includes an auxiliary light associated with at least one of the enclosure housing the traffic lights and rechargeable batteries associated with the auxiliary light. A power failure is detected by monitoring the voltage across the bulbs of the traffic lights and also preferably by monitoring the current in the common, neutral lead. When a power failure has been detected, the traffic light backup system engages and the auxiliary light is powered by the rechargeable batteries, preferably in a flashing fashion. In a preferred embodiment, the auxiliary light consists of a plurality of LEDs arranged in an octagonal manner. The LEDs have a high luminosity and lower power consumption, which makes them well suited for use even in broad daylight.

10 Claims, 6 Drawing Sheets

BATTERY CHARGER CIRCUIT

AUXILIARY LIGHT SOURCE DRIVE UNIT

TRAFFIC LIGHT BACKUP SYSTEM USING LIGHT-EMITTING DIODES

This application claims benefit of Provisional Application No. 60/112,337 Filed Dec. 16,1998.

FIELD OF THE INVENTION

The present invention relates to a traffic light backup system using light-emitting diodes (LEDs). Such a system allows traffic lights to function even though there might be a power failure.

DESCRIPTION OF THE PRIOR ART

The high prevalence of traffic lights for controlling the traffic flow attest to their effectiveness in reducing the incidence of accidents and, more recently, their utility in controlling the flow of traffic in large metropolitan areas when used in conjunction with computer control systems. Modern traffic lights are very similar to those used in the early 1900s. The basic traffic light still employs red, yellow and green filters over incandescent bulbs that are sequentially turned on and off by an electromechanical timing switch or by solid state controllers. Each bulb is electrically coupled to a conventional power source, such as the conventional power distribution network.

One of the main drawbacks associated with the use of conventional traffic lights arises in situations when the source of electrical energy to the bulbs is cut off, such as in the event of a power failure. The use of conventional traffic lights has become so widespread and embedded in present day transportation culture that such a situation often creates traffic chaos, and may provoke potentially dangerous situations. This problem has been recognized in at least two prior patents.

U.S. Pat. No. 5,010,336 to Mosele et al. discloses an auxiliary traffic light system including a strobe light connected to a battery operated circuit for flashing the strobe upon failure of the power source supplying the conventional traffic light.

U.S. Pat. No. 5,327,123 to Heinman et al. discloses a traffic control system including a light flasher structure connected to a controller. The controller is also electrically coupled to load switches for controlling the normal operation of the lights, and flashing at least one of the lights in the event of a system malfunction.

Although offering a partial solution to the problem of inexistence of traffic control in the event of a power failure, the previous systems are overly complex, have relatively low life cycle expectancy and have low visual efficiency. The latter problem is particularly evident in the case of a power failure in daytime, when the backup lights do not have enough power to be visible.

There thus exists a need for a traffic light backup system which minimizes power requirements, has a high luminous efficiency and is easier to install than the prior art devices.

SUMMARY OF THE INVENTION

It is an object of the invention to provide a traffic light backup system which minimizes power requirements and has a high luminous efficiency. In accordance with the invention, this object is achieved with a traffic light backup system for use with a traffic light, the traffic light comprising at least one enclosure housing a bulb, said traffic light having a primary lead for each of said at least one enclosure and a neutral lead, said bulb being electrically connected to the corresponding primary lead and the neutral lead, the traffic light backup system comprising an auxiliary light associated with at least one of said at least one enclosure; rechargeable backup power means associated with said auxiliary light; at least one primary power supply and power failure detection circuit, for providing power to said rechargeable backup power means during normal operating condition and for sensing a voltage across said bulb of said at least one enclosure and providing an output related to said voltage; and an electronic control module operatively connected to said auxiliary light, said rechargeable backup power means and said primary power supply and power failure detection circuit, for receiving power from said primary power supply and power failure detection circuit during normal operating condition in order to recharge said rechargeable backup power means, for receiving said output related to said voltage and for activating said auxiliary with said rechargeable backup power means when said electronic control module determines that a power failure has occurred.

In a preferred embodiment, the auxiliary light consists of a plurality of LEDs arranged in an octagonal shape on the inside of the enclosure.

Other objects and advantages will become apparent throughout the present description.

BRIEF DESCRIPTION OF THE DRAWINGS

The present invention and its advantages will be more easily understood after reading the following non-restrictive description of preferred embodiments thereof, made with reference to the following drawings in which.

DESCRIPTION OF A PREFERRED EMBODIMENT OF THE INVENTION

One of the principal objects of the present invention is the provision of a traffic light back-up system, in which auxiliary light sources in the form of light emitting diodes are used to illuminate the traffic lights during a power outage. The system also includes a primary power supply and power failure detection circuit; a secondary power failure detection circuit; a battery charger circuit; an auxiliary light source drive circuit and a central control unit.

Figure 1:
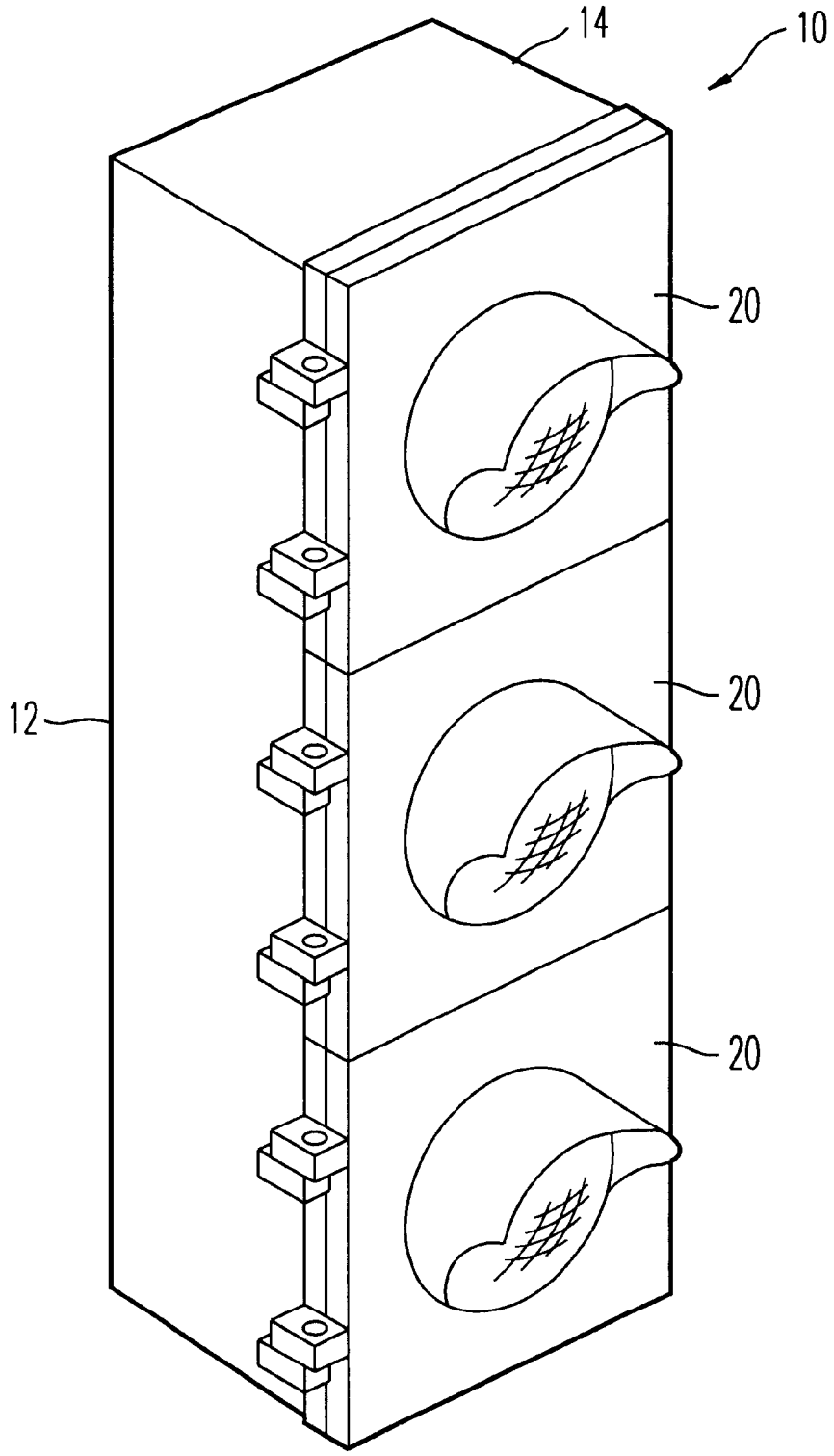
FIG. 1 is an outside view of a typical three-lamp traffic light.
Figure 2:
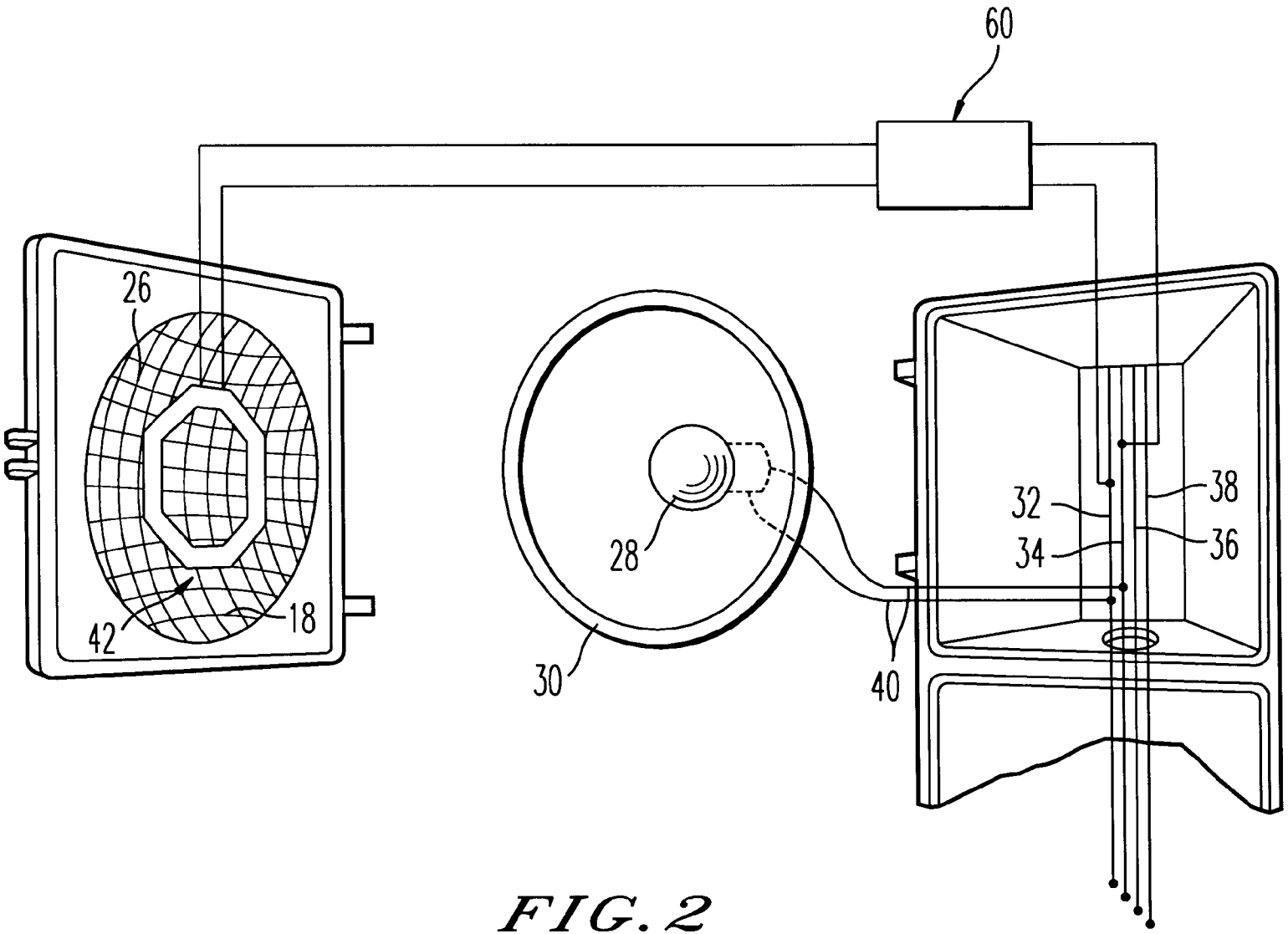
FIG. 2 is a perspective view of the inside of the traffic light of FIG. 1, with the auxiliary light sources fastened to the inside of the filter.

Referring now to FIGS. 1 and 2, there is shown a typical three lamp traffic light 10, within which the traffic light backup system of the present invention is integrated. The typical traffic light 10 includes three enclosures 20 housing in a casing having a top 14 and back 12, but can include more than three. Each enclosure 20 includes a bulb 28, a parabolic reflector 30, and power means, in this case four leads (one for each lamp, and a fourth for ground). More specifically, ground or neutral lead 32, is accompanied by coded primary leads 34, 36 and 38. Each bulb 28 is electrically connected to the neutral primary lead 32 and one of the primary coded leads 34, 36, or 38 through wires 40.

In order to provide the adequate colour to the traffic light, a filter 18 is also provided on the inside of a concave, transparent or translucent area 26, which is usually glass or plastic.

It should be understood that a typical traffic light 10 can include more elements, and can be in a different configuration; however, for the purposes of illustration of the present invention, only the more important components are schematically illustrated. It should also be understood that the present invention can be used with other types of traffic lights without departing from the scope of the present invention, by making appropriate modifications.

Figure 3:
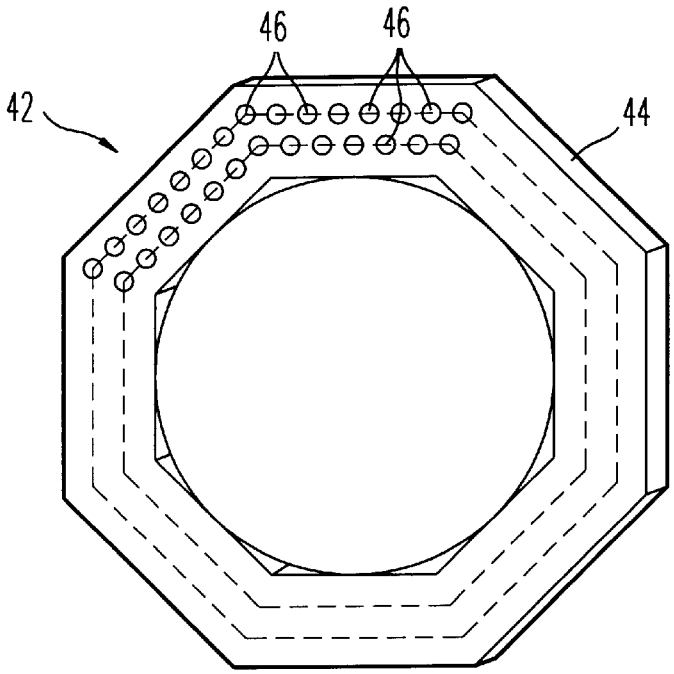
FIG. 3 is a front elevational view of the auxiliary light sources in a preferred configuration.
Figure 4:
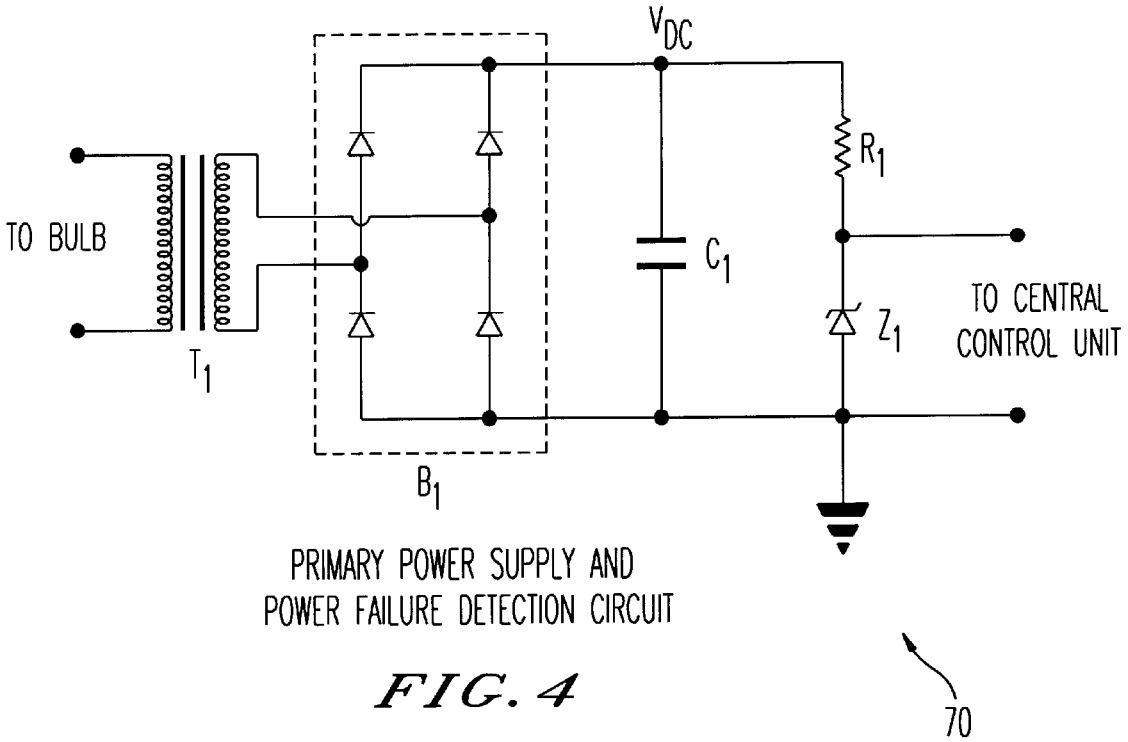
FIG. 4 is a circuit diagram of the primary power supply and power failure detection circuit according to a preferred embodiment of the invention.

Referring now specifically to FIG. 2, the traffic light backup system includes auxiliary light source 42 and electronic control module 60. Auxiliary light source 42 is shown in greater detail in FIG. 3, and includes a support panel 44 on which are mounted a plurality of light emitting diodes (LEDs) 46. LEDs have been selected for the present invention for offering adequate luminosity and low power consumption. However, it should be apparent to a person skilled in the field that the present invention is not limited to LEDs, and that any other light source which provides adequate luminosity and low power consumption will meet the objects of the present invention.

The support panel 44 preferably has a flat configuration and is preferably made out of a relatively flexible material so as to allow the latter to be secured to the interior surface of the concave area 26.

In a preferred embodiment of the invention, the support panel 44 is given the configuration of a generally octagonal rim so as to simulate the appearance of the peripheral edge of a conventional warning or stop sign or signal. The light emitting diodes are also preferably of the high intensity type so as to provide adequate visual characteristics regardless of the ambient light conditions around the typical traffic light.

The auxiliary light sources 42 are driven by electronic control module 60 to which are operatively connected the following subsystems: a primary power supply and power failure detection circuit; a secondary power failure detection circuit; a battery charger circuit; an auxiliary light source drive circuit.

The primary power supply and power failure detection circuit 70 consists of an electrical transformer T1 connected in parallel with one of the primary leads 34, 36, 38 (of the red, yellow or green lights) and the neutral lead 32. The transformer secondary voltage is rectified by means of a diode bridge B1 and subsequently filtered by means of a capacitor C1. The filtered voltage, $V_{DC}$, is used to power the electronic module and charge the batteries. A zener diode Z1 in series with a resistance R1 is connected across $V_{Dc}$ and is used to provide a digital signal (on or off) to the central control unit 110 indicating the presence of a voltage on the primary side of the transformer. The absence of a voltage on the primary side of the transformer does not necessarily indicate a power failure since, during the normal operation of the traffic light system, the power supplied to each bulb is inherently intermittent. A power failure can be reliably detected by providing a transformer and the associated circuitry for each of the bulbs within the traffic light enclosure. A power failure is then detected when none of the digital signals provided by the power failure detection circuits indicates the presence of a voltage on the primary side of the transformer (i.e. no bulb at any one time is illuminated).

Unfortunately, this strategy of power failure detection necessitates the installation of a transformer for each bulb within the traffic light enclosure. Since transformers are relatively expensive and bulky, this significantly increases the size and cost of the system as well as compromises the ease of installation of the system. It is also important to note that while the majority of traffic light enclosures incorporate three bulbs (red, yellow and green), many incorporate five or more and would require an equivalent number of transformers and associated circuitry. Accordingly, in a preferred embodiment of the invention, only one such primary power supply and power failure detection circuit 70 is used and is connected to one of the primary leads, preferably the red bulb lead (and of course the neutral lead). However, the present invention provides for the advantageous use of an additional circuit.

Figure 5:
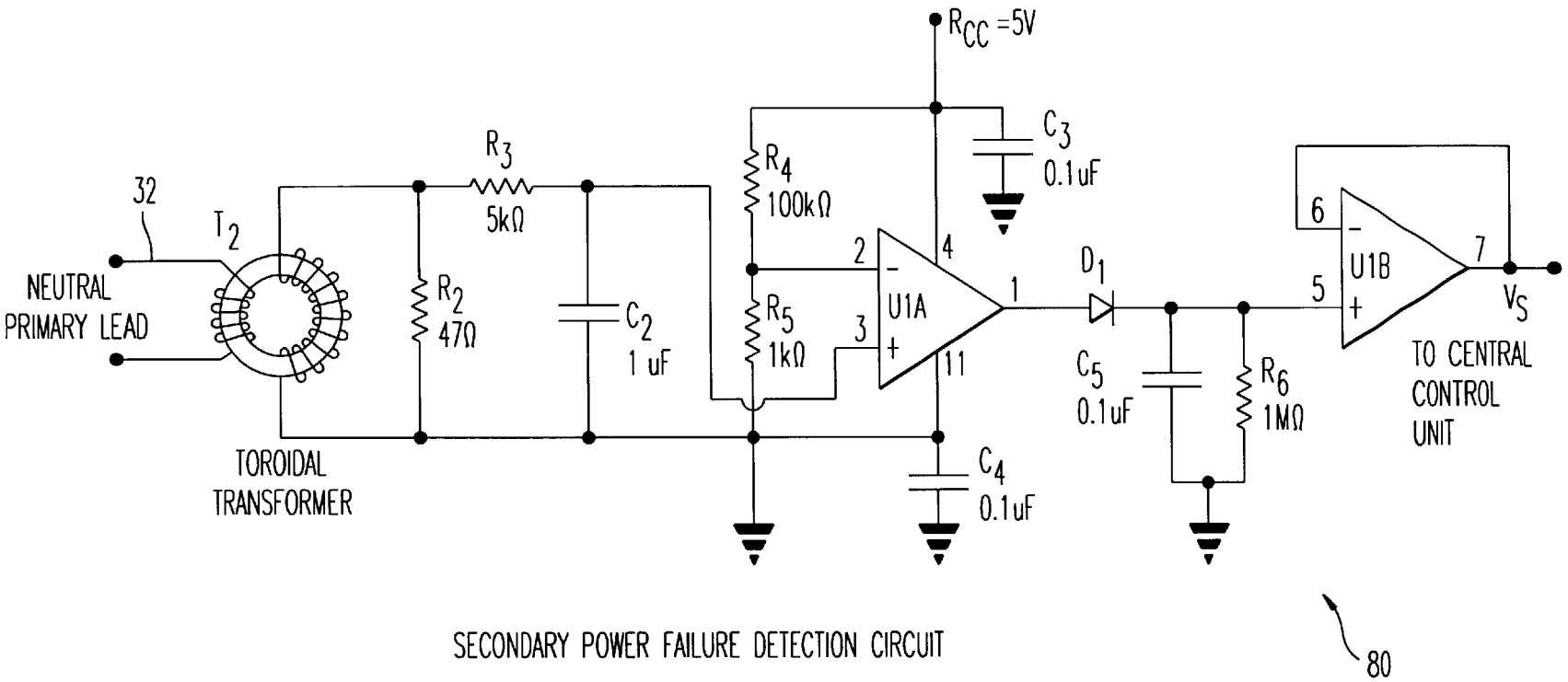
FIG. 5 is a circuit diagram of the secondary power failure detection circuit according to a preferred embodiment of the invention.

In order to reduce the cost, complexity and size of the electronic control module, the additional circuit, or secondary power failure detection circuit 80, detects the presence of a current in the neutral primary lead 32 common to all bulbs. When a power failure occurs, there is no electrical current provided to any of the bulbs and consequently, no current flows through the neutral primary lead 32. The secondary power failure detection circuit 80 is based on a toroidal transformer T2. The neutral primary lead 32 is looped several times through the center of the toroidal transformer T2 and constitutes the primary. When a current flows through the neutral primary lead 32, a current is induced in the secondary windings of the transformer. A voltage is obtained by passing the secondary current through a resistance R2. An operational amplifier U1A serves as a comparator and provides a digital signal (on or off) to the central control unit 110 indicating the presence of a current in the neutral primary lead 32. FIG. 5 shows a complete power failure detection circuit according to a preferred embodiment of the invention; however, is should be understood that a main aspect of this circuit is the detection of a current in the neutral lead 32, and associated circuitry which accomplishes this goal is well within the skill of a person versed in this field. A power failure is assumed to have occurred when the primary power supply voltage, $V_{DC}$, and the current flowing through the neutral primary lead 32 are both zero.

A defective bulb will also result in zero current through the neutral primary lead 32. One of the advantages of the present invention is that the system can provide an auxiliary visual cue to drivers in the event of either a power failure or a defective bulb. For example, the system of the present invention can detect a defective red or yellow bulb if the primary circuit is associated with the green bulb. Once a defective bulb is detected, the system can use the alternate light source to replace the defective bulb. When the primary power supply and power detection circuit is connected to the green bulb, the electronic control module need not necessarily respond to a defective green bulb since the voltage across the green bulb is sensed directly. In other words, no current flowing through the neutral primary lead in conjunction with the presence of a voltage across the green bulb indicates a defective green bulb. No current flowing through the neutral primary lead in conjunction with the absence of a voltage across the green bulb indicates a power failure or a defective red (or yellow) bulb. The central control unit is programmed to respond accordingly and other variations are possible while respecting the spirit of the present invention.

It should be noted that in those installations where a direct, uninterrupted line to the power main is available within the traffic light enclosure, only the primary power supply and power failure detection circuit is required to reliably detect a power failure. Unfortunately, in the vast majority of installations, this is not the case.

Figure 6:
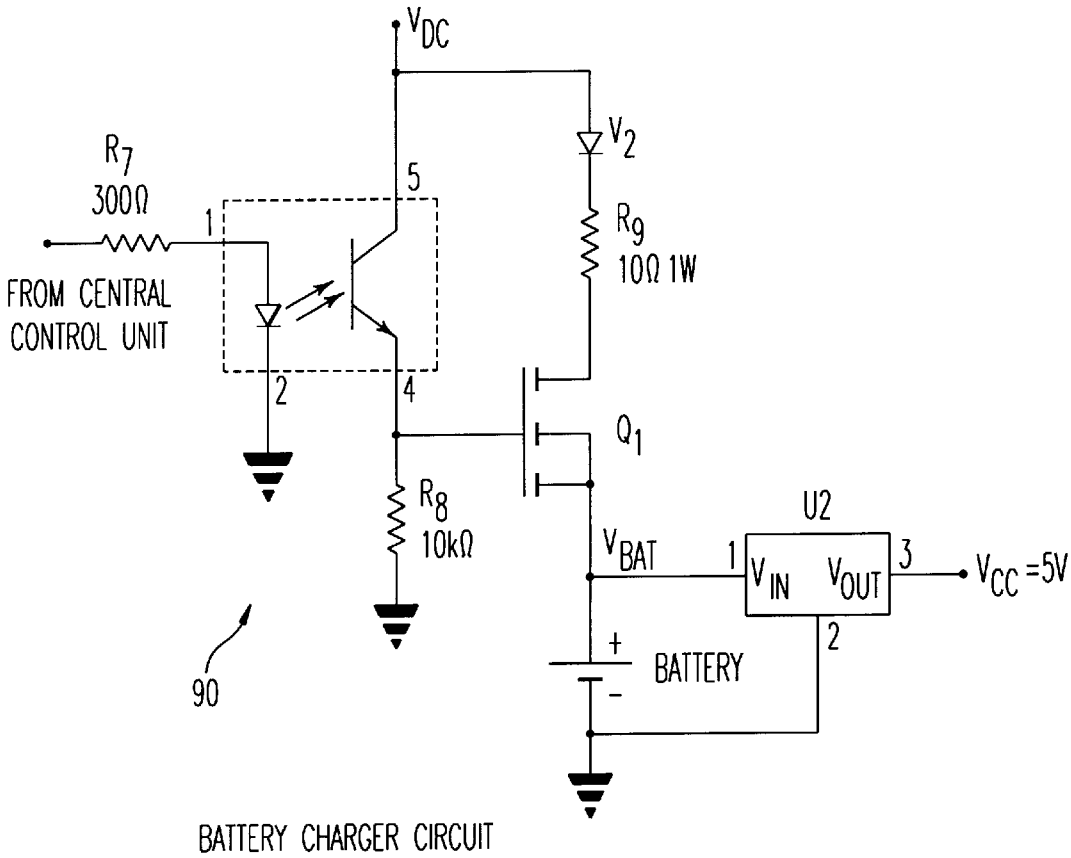
FIG. 6 is a circuit diagram of the battery charger circuit according to the preferred embodiment of the invention.
Figure 7:
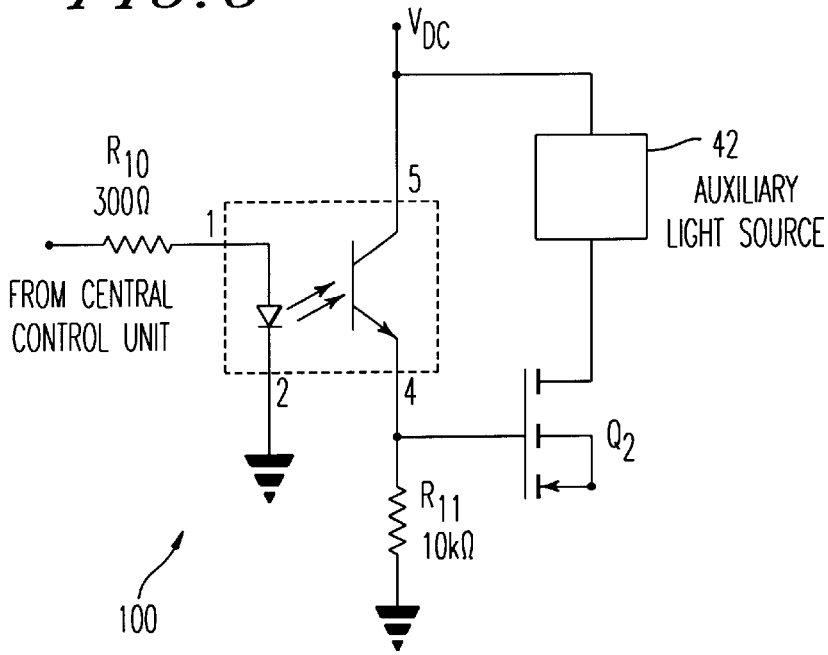
FIG. 7 is a circuit diagram of the auxiliary light source drive unit according to the preferred embodiment of the invention.
Figure 8:
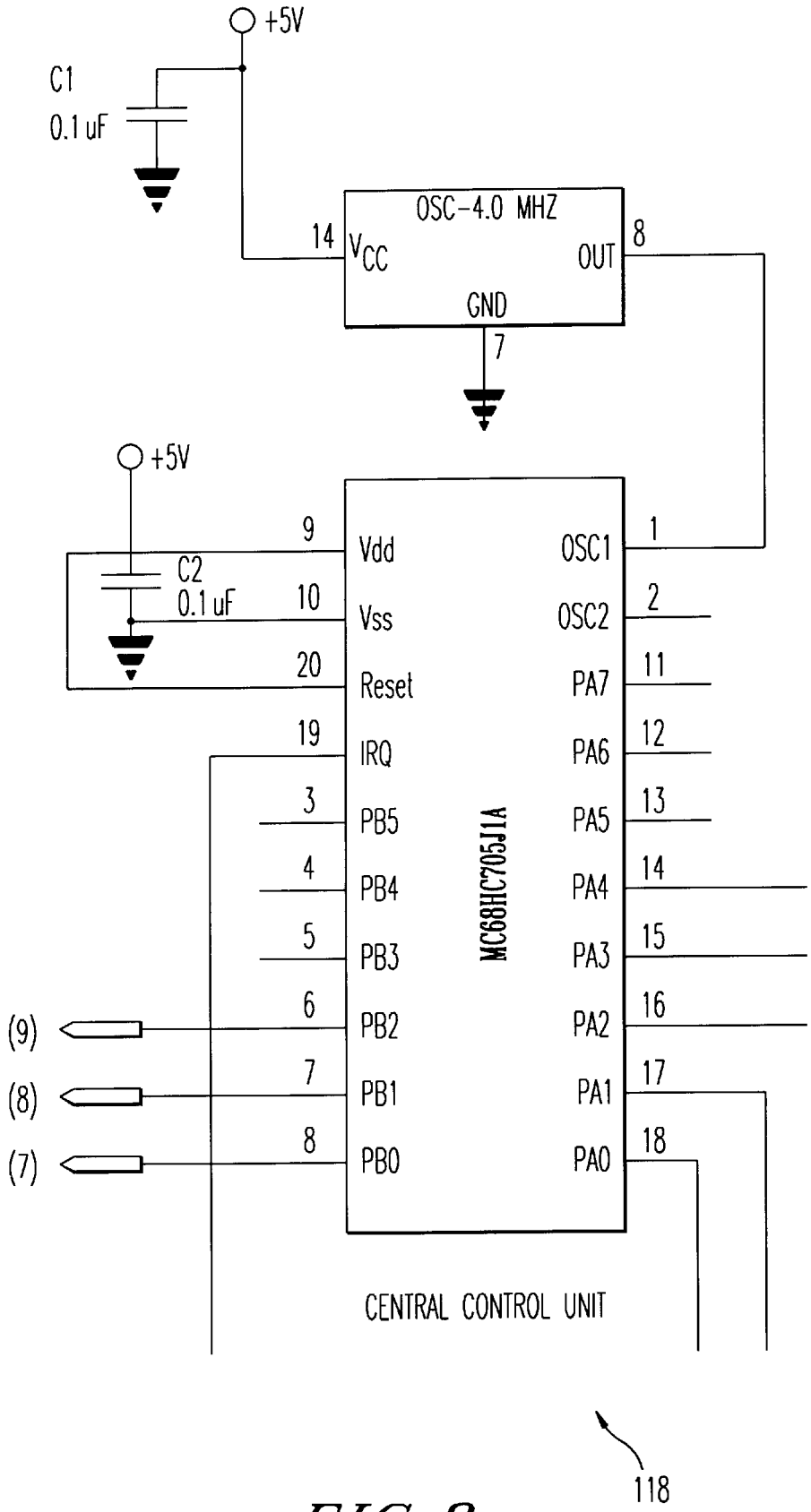
FIG. 8 is a schematic representation of the electronic control module according to a preferred embodiment of the invention.

The battery charger circuit 90 consists of a MOSFET transistor Q1 which is activated through an opto-isolator by the central control unit and which is used to switch on or off the current flowing from the primary power supply and power failure detection circuit to the battery (or batteries). A resistance is placed in series with the drain of the transistor in order to limit the charging current to preferably approximately 250 mA. A diode is placed in series with the resistance to block the reverse current from the batteries to the power supply and power failure detection circuit should the primary power supply $V_{DC}$ fall below the battery voltage $V_{BAT}$. A series regulator is used to generate the voltage required by the electronic control module from the unregulated battery voltage $V_{BAT}$. FIG. 6 shows a battery charger circuit according to a preferred embodiment of the invention. However, it should be understood that equivalent circuits can also be used. It will also be understood that if only one primary circuit 70 is used, current provided to the batteries for charging is intermittent (i.e. since any given bulb is intermittently switched on).

The auxiliary light source drive circuit 100 consists of a MOSFET transistor which is activated through an opto-isolator by the central control unit. This circuit is used to switch on or off the auxiliary light source in the event of a power failure.

The electronic control module 60 is preferably embodied in an integrated circuit and includes a central control 110 unit which is preferably a micro-controller based circuit which manages the operation of the traffic light backup system of the present invention. The central control unit monitors the battery voltage by means of two comparators which provide digital signals indicating whether the battery voltage is too high or too low. The central control unit leaves the charging current continuously on unless the high battery voltage signal is active. In the event of a power failure, the central control unit maintains the auxiliary light source active (i.e. flashing) until either main power is restored or until the battery voltage drops dangerously low as indicated by the low battery voltage signal. This latter reason is to prevent the batteries from discharging completely, which would render them un-rechargeable.

The central control unit senses a power failure by means of either the primary power supply and power failure detection circuit or the secondary power failure detection circuit, or a logical combination of the two. Alternatively, the central control unit can also detect a power failure by verifying whether or not the primary power supply voltage $V_{DC}$ returns within a prescribed period of time. For example, if under normal operating conditions the green light is off for 40 seconds per cycle, the central control unit expects the primary power supply voltage to return after 40 seconds. Failure to do so indicates a power interruption.

In response to a power failure, the central control unit activates the auxiliary light source after a pre-programmed delay. The delay is to account for the short interruptions in the power supply that can occur during normal operation of the traffic lights (due to a flashing green light, for example). In order to conserve battery power and to provide a better visual cue to the drivers, the central control unit preferably flashes the auxiliary light source on and off at a predetermined rate (typically once every second).

As can be seen from the above, advantages of the present invention include the provision of a traffic light backup system that provides an auxiliary visual source of information when the conventional primary traffic light system becomes inoperative as a result of a power failure. The present invention provides a substitute traffic light in a conventional traffic light housing and in a position where a driver expects to see a traffic signal.

Furthermore, the present invention is specifically designed so as to be readily mountable to the configuration of conventional traffic lights without requiring special tooling or manual dexterity. The present invention thus eliminates the need for the installation of costly wiring such as needed for devices using auxiliary light sources controlled from a main controller.

Finally, the present invention is specifically designed so as to provide an auxiliary visual signal having relatively high luminous efficiency, while reducing power usage and thus inherently increasing its autonomy.

Although the present invention has been explained hereinabove by way of a preferred embodiment thereof, it should be pointed out that any modifications to this preferred embodiment within the scope of the appended claims is not deemed to alter or change the nature and scope of the present invention.

What is claimed is:

1. A traffic light backup system for use with a traffic light, the traffic light comprising at least one enclosure housing a bulb, said traffic light having a primary lead for each of said at least one enclosure and a neutral lead, said bulb being electrically connected to the corresponding primary lead and the neutral lead, the traffic light backup system comprising:

an auxiliary light source associated with at least one of said at least one enclosure;

rechargeable backup power means associated with said auxiliary light source;

at least one primary power supply and power failure detection circuit, for providing power to said rechargeable backup power means during a normal operating condition and for sensing a voltage across said bulb of said at least one enclosure and providing an output related to said voltage;

an electronic control module operatively connected to said auxiliary light source, said rechargeable backup power means and said primary power supply and power failure detection circuit, for receiving power from said primary power supply and power failure detection circuit during the normal operating condition in order to recharge said rechargeable backup power means, for receiving said output related to said voltage and for activating said auxiliary light source with said rechargeable backup power means when said electronic control module determines that a power failure has occurred; and a secondary power failure detection circuit for sensing a current in said neutral lead.

2. A traffic light backup system according to claim 1, wherein said traffic light includes at least three enclosures, a first one housing a red bulb, a second one housing a yellow bulb and a third one housing a green bulb, and wherein said auxiliary light source is associated with said enclosure housing said red bulb and wherein said traffic light backup system comprises one primary power supply and power failure detection circuit operatively associated with one of said red bulb and said green bulb.

3. A traffic light backup system according to claim 2, wherein said auxiliary light source comprises a plurality of LEDs.

4. A traffic light backup system according to claim 3, wherein said plurality of LEDs are arranged in an octagonal shape on the inside of said enclosure housing said red bulb.

5. A traffic light backup system according to claim 1, wherein said rechargeable backup power means comprise at least one rechargeable battery.

6. A traffic light backup system for use with a traffic light, the traffic light comprising at least one enclosure housing a bulb, said traffic light having a primary lead for each of said at least one enclosure and a neutral lead, said bulb being electrically connected to the corresponding primary lead and the neutral lead, the traffic light backup system comprising:

an auxiliary light source associated with at least one of said at least one enclosure;

a rechargeable backup power mechanism associated with said auxiliary light source;

at least one primary power supply and power failure detection circuit configured to provide power to said rechargeable backup power mechanism during a normal operating condition, to sense a voltage across said bulb of said at least one enclosure, and to provide an output related to said voltage;

an electronic control module operative connected to said auxiliary light source, said rechargeable backup power mechanism and said primary power supply and power failure detection circuit, to receive power from said primary power supply and power failure detection circuit during the normal operating condition in order to recharge said rechargeable backup power mechanism, and to receive said output related to said voltage and to activate said auxiliary light source with said rechargeable backup power mechanism when said electronic control module determines that a power failure has occurred; and a secondary power failure detection circuit configured to sense a current in said neutral lead.

7. A traffic light backup system according to claim 1, wherein said traffic light includes at least three enclosures, a first one housing a red bulb, a second one housing a yellow bulb and a third one housing a green bulb, wherein said auxiliary light source is associated with said enclosure housing said red bulb, and wherein said traffic light backup system comprises one primary power supply and power failure detection circuit operatively associated with one of said red bulb and said green bulb.

8. A traffic light backup system according to claim 7, wherein said auxiliary light source comprises a plurality of LEDs.

9. A traffic light backup system according to claim 8, wherein said plurality of LEDs are arranged in an octagonal shape on the inside of said enclosure housing said red bulb.

10. A traffic light backup system according to claim 6, wherein said rechargeable backup power mechanism comprise at least one rechargeable battery.

* * * * *